US009912110B2

(12) United States Patent
Edmonds

(10) Patent No.: US 9,912,110 B2
(45) Date of Patent: Mar. 6, 2018

(54) COAXIAL CABLE CONNECTOR WITH CONTINUITY MEMBER

(71) Applicant: PCT International, Inc., Mesa, AZ (US)

(72) Inventor: Samuel S. Edmonds, Gilbert, AZ (US)

( * ) Notice: Subject to any disclaimer, the term of this patent is extended or adjusted under 35 U.S.C. 154(b) by 0 days.

(21) Appl. No.: 15/217,903

(22) Filed: Jul. 22, 2016

(65) Prior Publication Data

US 2017/0025801 A1 Jan. 26, 2017

Related U.S. Application Data

(60) Provisional application No. 62/196,892, filed on Jul. 24, 2015, provisional application No. 62/210,268, filed on Aug. 26, 2015.

(51) Int. Cl.

| | |
|---|---|
| ***H01R 13/62*** | (2006.01) |
| ***H01R 24/40*** | (2011.01) |
| ***H01R 13/622*** | (2006.01) |
| *H01R 13/52* | (2006.01) |
| *H01R 103/00* | (2006.01) |
| *H01R 9/05* | (2006.01) |

(52) U.S. Cl.

CPC ..... *H01R 24/40* (2013.01); *H01R 13/622* (2013.01); *H01R 9/0524* (2013.01); *H01R 13/5202* (2013.01); *H01R 2103/00* (2013.01)

(58) Field of Classification Search

CPC ..... H01R 2103/00; H01R 9/0521
USPC ..... 439/322, 584
See application file for complete search history.

(56) References Cited

U.S. PATENT DOCUMENTS

| | | | |
|---|---|---|---|
| 3,199,061 | A | 8/1965 | Johnson et al. |
| 4,106,839 | A | 8/1978 | Cooper |
| 4,377,320 | A | 3/1983 | Lanthrop et al. |
| 4,741,710 | A | 5/1988 | Hogan et al. |
| 4,990,106 | A | 2/1991 | Szegda |
| 5,147,229 | A | 9/1992 | Nestor |
| 5,466,173 | A | 11/1995 | Down |
| 5,498,175 | A | 3/1996 | Yeh et al. |
| 5,501,616 | A | 3/1996 | Holliday |
| 6,010,289 | A | 1/2000 | Distasio et al. |
| 6,042,422 | A | 3/2000 | Youtsey |
| 6,425,782 | B1 | 7/2002 | Holland |
| 6,648,683 | B2 | 11/2003 | Youtsey |
| 6,712,631 | B1 | 3/2004 | Youtsey |
| 6,767,248 | B1 | 7/2004 | Hung |
| 7,144,272 | B1 | 12/2006 | Burris et al. |
| 7,364,462 | B2 | 4/2008 | Holland |

(Continued)

FOREIGN PATENT DOCUMENTS

TW 201230530 A1 7/2012

*Primary Examiner* — Phuong Chi T Nguyen
(74) *Attorney, Agent, or Firm* — Thomas W. Galvani, P.C.; Thomas W. Galvani

(57) ABSTRACT

A coaxial cable connector for coupling a coaxial cable to an electronic component includes a body, a post in the body, and a coupling nut mounted for movement on the post. A continuity member is disposed radially between the post and the coupling nut, and an electrical continuity is established and maintained among the coupling nut, the continuity member, and the post. The electrical continuity is maintained in a radial direction only, regardless of the tightness of the coupling nut on the post, and regardless of compression of the continuity member beyond a pre-loaded compression.

22 Claims, 7 Drawing Sheets

(56) References Cited

U.S. PATENT DOCUMENTS

| | | | | |
|---|---|---|---|---|
| 7,377,809 | B2 | 5/2008 | Dyck | |
| 7,510,432 | B2 | 3/2009 | Entsfellner | |
| 7,527,524 | B1 | 5/2009 | Coleman et al. | |
| 7,753,727 | B1 | 7/2010 | Islam et al. | |
| 7,934,953 | B1 | 5/2011 | Solis | |
| 7,976,339 | B2 | 7/2011 | Buck et al. | |
| 8,029,316 | B2 | 10/2011 | Snyder et al. | |
| 8,444,433 | B2 | 5/2013 | Snyder et al. | |
| 8,469,739 | B2 | 6/2013 | Rodrigues et al. | |
| 8,517,763 | B2 | 8/2013 | Burris et al. | |
| 8,556,654 | B2 | 10/2013 | Chastain et al. | |
| 8,579,658 | B2 | 11/2013 | Youtsey | |
| 8,690,603 | B2 | 4/2014 | Bence et al. | |
| 8,753,137 | B2 * | 6/2014 | Lu | H01R 9/0524 439/322 |
| 8,753,147 | B2 | 6/2014 | Montena | |
| 8,840,429 | B2 | 9/2014 | Thomas et al. | |
| 8,894,440 | B2 | 11/2014 | Rodrigues et al. | |
| 8,944,846 | B2 | 2/2015 | Lee | |
| 8,961,224 | B2 | 2/2015 | Grek et al. | |
| 9,039,446 | B2 | 5/2015 | Youtsey | |
| 9,071,019 | B2 | 6/2015 | Burris et al. | |
| 9,083,113 | B2 | 7/2015 | Wild et al. | |
| 9,257,780 | B2 | 2/2016 | Thomas et al. | |
| 9,343,855 | B2 | 5/2016 | Wei | |
| 2002/0164900 | A1 | 11/2002 | Youtsey | |
| 2004/0048514 | A1 | 3/2004 | Kodaira | |
| 2005/0148236 | A1 | 7/2005 | Montena | |
| 2009/0053928 | A9 | 2/2009 | Entsfellner | |
| 2010/0261380 | A1 | 10/2010 | Skeels et al. | |
| 2010/0297875 | A1 | 11/2010 | Purdy et al. | |
| 2012/0021642 | A1 | 1/2012 | Zraik | |
| 2012/0270439 | A1 | 10/2012 | Tremba et al. | |
| 2012/0329311 | A1 | 12/2012 | Duval et al. | |
| 2013/0137299 | A1 | 5/2013 | Chastain et al. | |
| 2013/0164975 | A1 | 6/2013 | Blake et al. | |
| 2013/0316577 | A1 | 11/2013 | Wang | |
| 2013/0330967 | A1 | 12/2013 | Youtsey | |
| 2014/0051285 | A1 | 2/2014 | Raley et al. | |
| 2014/0120757 | A1 | 5/2014 | Purdy et al. | |
| 2014/0141646 | A1 | 5/2014 | Lu | |
| 2014/0148051 | A1 | 5/2014 | Bence et al. | |
| 2014/0342594 | A1 | 11/2014 | Montena | |
| 2015/0024627 | A1 | 1/2015 | Wei | |
| 2015/0050825 | A1 | 2/2015 | Krenceski et al. | |
| 2015/0118901 | A1 | 4/2015 | Burris | |
| 2015/0162675 | A1 | 6/2015 | Davidson, Jr. et al. | |
| 2015/0180141 | A1 | 6/2015 | Wei | |

* cited by examiner

COAXIAL CABLE CONNECTOR WITH CONTINUITY MEMBER

CROSS-REFERENCE TO RELATED APPLICATIONS

This application claims the benefit of U.S. Provisional Application No. 62/196,892, filed Jul. 24, 2015, and of U.S. Provisional Application No. 62/210,268, filed Aug. 26, 2015, both of which are hereby incorporated by reference.

FIELD OF THE INVENTION

The present invention relates generally to electronic devices, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components. Typical coaxial cables include an inner conductor surrounded by a flexible dielectric insulator, a foil layer and/or a metallic braided sheath or shield, and a flexible polyvinylchloride jacket. The RF signal is transmitted through the inner conductor. The conductive sheath provides a ground and inhibits electrical and magnetic interference with the RF signal in the inner conductor.

Coaxial cables must be fit with cable connectors to be coupled to electronic components. Connectors typically have a connector body, a threaded fitting or coupling nut mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. The connectors must maintain electrical connection and signal shielding with the cable despite rotation, tugging, bending, or other movement of the cable and the connector. Movement of the cable and the connector may occur suddenly if an object contacts the cable or connector, but may also occur slowly over time, such as from cyclical heating and cooling or wind loads on outside installations.

Some approaches to maintaining continuity have focused on maintaining a connection between the coupling nut and the post by biasing the nut in an axial direction so as to force the nut into continuity. This has generally been accomplished by loading the nut axially with a spacer, washer, or other shimming device. Typically, such biasing devices are disposed axially between the nut and the body of the connector and urge the nut axially forward into contact with a forward flange on the post. However, should the biasing device not provide an even force continuously around the entire device, the nut may not mate continuously flush against the post, which can lead to leaks in signal, degradation of continuity, and impingement of RF interference into the connector. Further, if the connector is bent, such as frequently occurs when the cable extending from the connector flexes or is bent, the nut will not mate continuously flush against the post, leading to the above-stated problems.

Other biasing devices have been used to shim the nut against the post. Such devices are typically disposed annularly between the nut and the post and have a ramped or wedge-like profile. When the nut is tightened onto the mating port of an electronic component, the biasing device is compressed and exerts an axial bias along its ramp against the nut, thereby causing the nut to move forwardly into contact with the forward flange on the post so as to establish continuity. U.S. Pat. No. 8,517,763 describes an integrally conductive locking coaxial connector that relies on such operation for continuity: a rear flange of the nut has an inclined inner surface that roughly corresponds to a ramped outer surface of a washer disposed between the nut and the post which the washer surrounds. When the nut is not applied to the mating port, the washer is loose in a space between the nut and post: it can wobble and lose contact and be free of either the nut or the post. Thus, when the nut is not applied to the mating port, electrical continuity between the nut and the port is not established and maintained. When the nut is applied to the mating port but not tightened, the same problem exists: the washer is loose and does not maintain continuity between the nut and the mating port. The connector in the '763 patent requires the coupling nut to be tightened on the mating port; when the nut is threadably engaged and tightened onto a mating port, the nut advances forward on the post and its inclined inner surface encounters the ramped outer surface of the washer, thereby forcing the washer forward as well, into confrontation with a forward flange of the post and against which the washer is axially compressed. This axial compression of the washer between the post and the nut maintains electrical continuity in an axial direction through the connector.

Other connectors rely on compression in a similar fashion. For instance, U.S. Pat. No. 9,343,855 discloses a spring-like washer element disposed between the post and the coupling nut mounted on the post. The washer element there includes a number of obliquely-projecting flexible fingers. These fingers roughly correspond to an inner chamfer or inclined surface of a rear flange on the coupling nut. An annular base portion of the washer element encircles the post, and the fingers project radially outward and axially forward from that base portion. When the connector is free of the mating port, the washer element is loose and does not maintain continuity between the coupling nut and the post. Likewise, the washer element is still loose when the connector is applied to the mating port but not tightened. Only when the connector is tightened is continuity established. As with the connector of the '763 patent, continuity through tightness requires the washer to be compressed. In the case of the '763 patent, the washer is compressed both axially and radially by the inclined surface of the rear flange on the coupling nut. This causes the washer to lock the coupling nut with respect to the post and body of the connector.

The connectors of the '763 and '855 patents exemplify the problem experienced by connectors that rely on compressing a washer in order to maintain continuity: they bind, seize up, are difficult to use, and are vulnerable to exterior forces backing the connector of mating port. When the connector binds, it becomes increasingly difficult or impossible to turn, which makes installation difficult: many technicians rely on the feel of increased rotational resistance when applying a connector to the post of an electronic component to determine when the connector is fully seated on the mating port. This "feel" leverages what is known as high free nut torque: essentially, the torque required to rotate the nut on the connector even before the nut is mated and seated to the mating port. When free nut torque is low, the nut is easy to rotate and it is very easy to tell when the nut is properly seated and mated with mating port of the electronic component: the torque required to turn the nut suddenly and dramatically increases. When free nut torque is high, the nut is difficult to rotate and it becomes difficult for an installer to determine whether the connector is properly seated with a mating port because the torque required to rotate the coupling nut increases by a relatively minor amount, but yet still binds. Most conventional continuity connectors have very high free nut torque.

When the nut binds prematurely because of the axial forces imparted by a shim or other biasing device, the technician can be fooled into thinking that the connector is properly installed on the mating port, when it may only be partially installed. This is a lack of continuity which leads to a degradation of signal quality. Further, should the nut be cross-threaded or not be evenly applied on the threads of the post of the electronic component, the coupling nut may not mate continuously flush against the mating port, which can further lead to leaks in signal, degradation of continuity, and impingement of RF interference into the connector. And again, if the connector is bent, the nut will not mate continuously flush against the mating port, leading to the above-stated problems. The reliance of such connectors on the existence and exertion of compression and/or axial forces to establish continuity is at best undesirable and at worst impractical and forces a corresponding dependence on perfect and precise design dimensioning and manufacturing dimensional tolerances, perfect assembly, and proper installation and operation, which is rarely possible in the real world. A connector that provides improved connectivity and continuity is needed.

SUMMARY OF THE INVENTION

A coaxial cable connector for coupling a coaxial cable to an electronic component includes a body, a post in the body, and a coupling nut mounted for movement on the post. A continuity member is disposed radially between the post and the coupling nut, and an electrical continuity is established and maintained among the coupling nut, the continuity member. The electrical continuity is maintained in a radial direction only, regardless of the application status of the connector on a mating port of the electronic component, regardless of the tightness of the coupling nut on the post, and regardless of compression of the continuity member beyond a pre-loaded compression.

BRIEF DESCRIPTION OF THE DRAWINGS

Referring to the drawings.

DETAILED DESCRIPTION

Figure 1A:
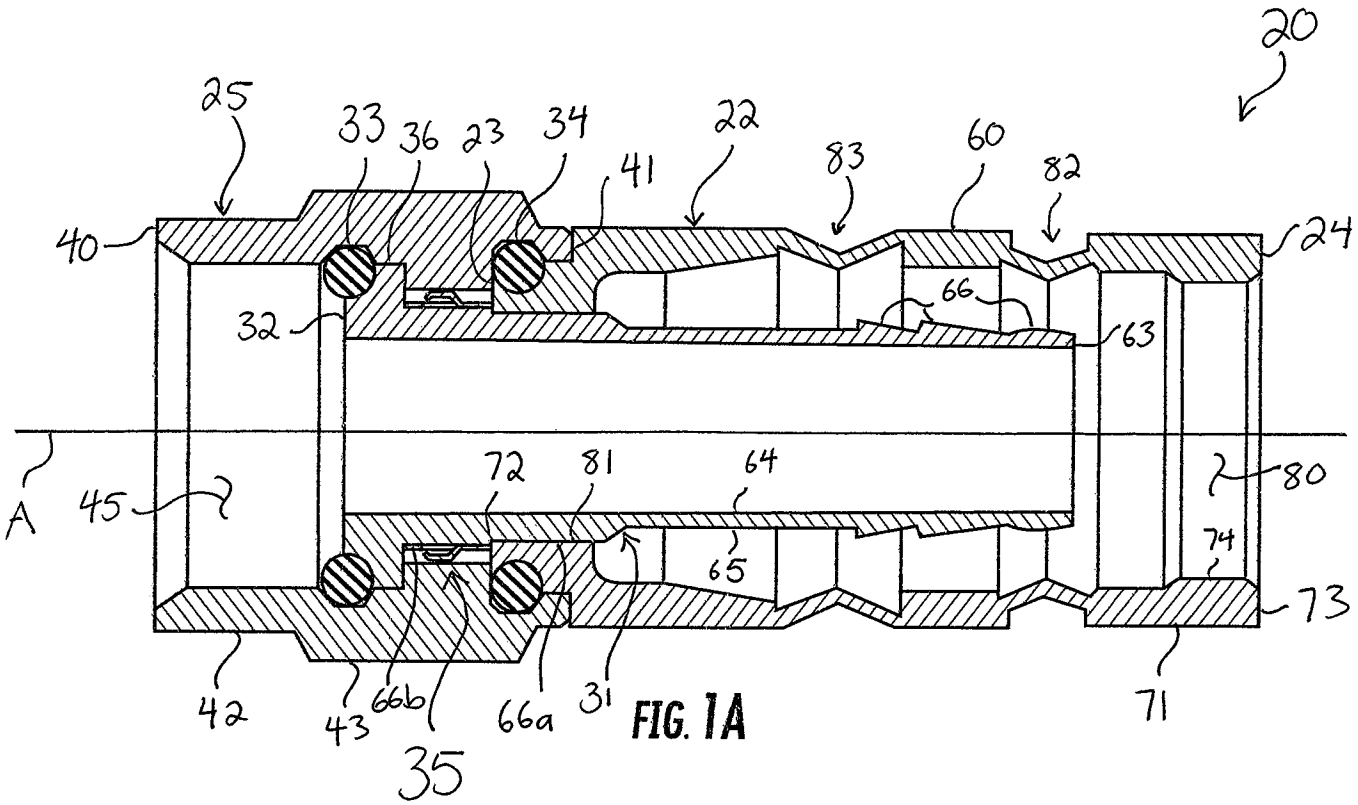
FIGS. 1A and 1B are section views bisecting a coaxial cable connector having a continuity member, showing the connector in an uncompressed condition and a compressed condition, respectively.
Figure 1B:
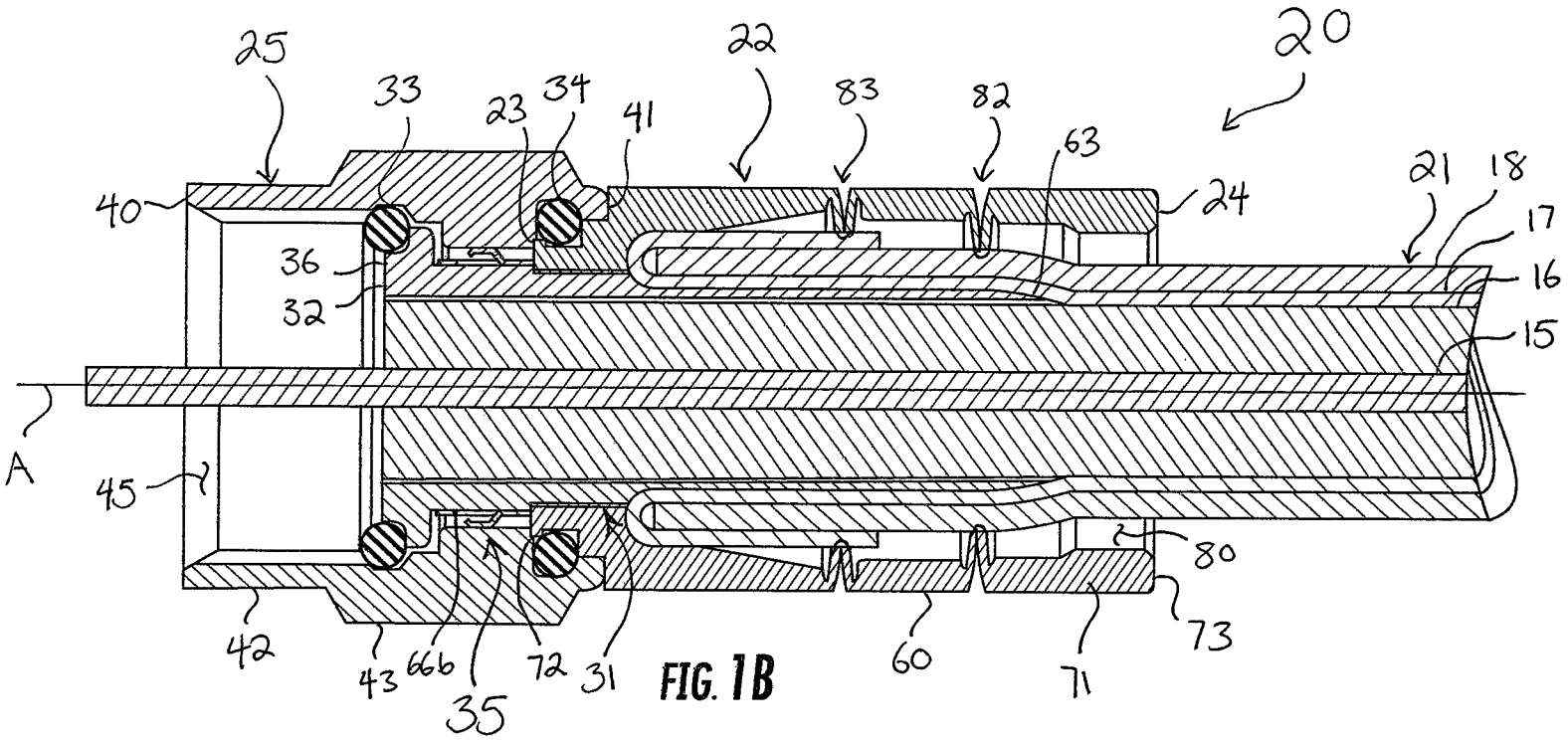
Figure 1C:
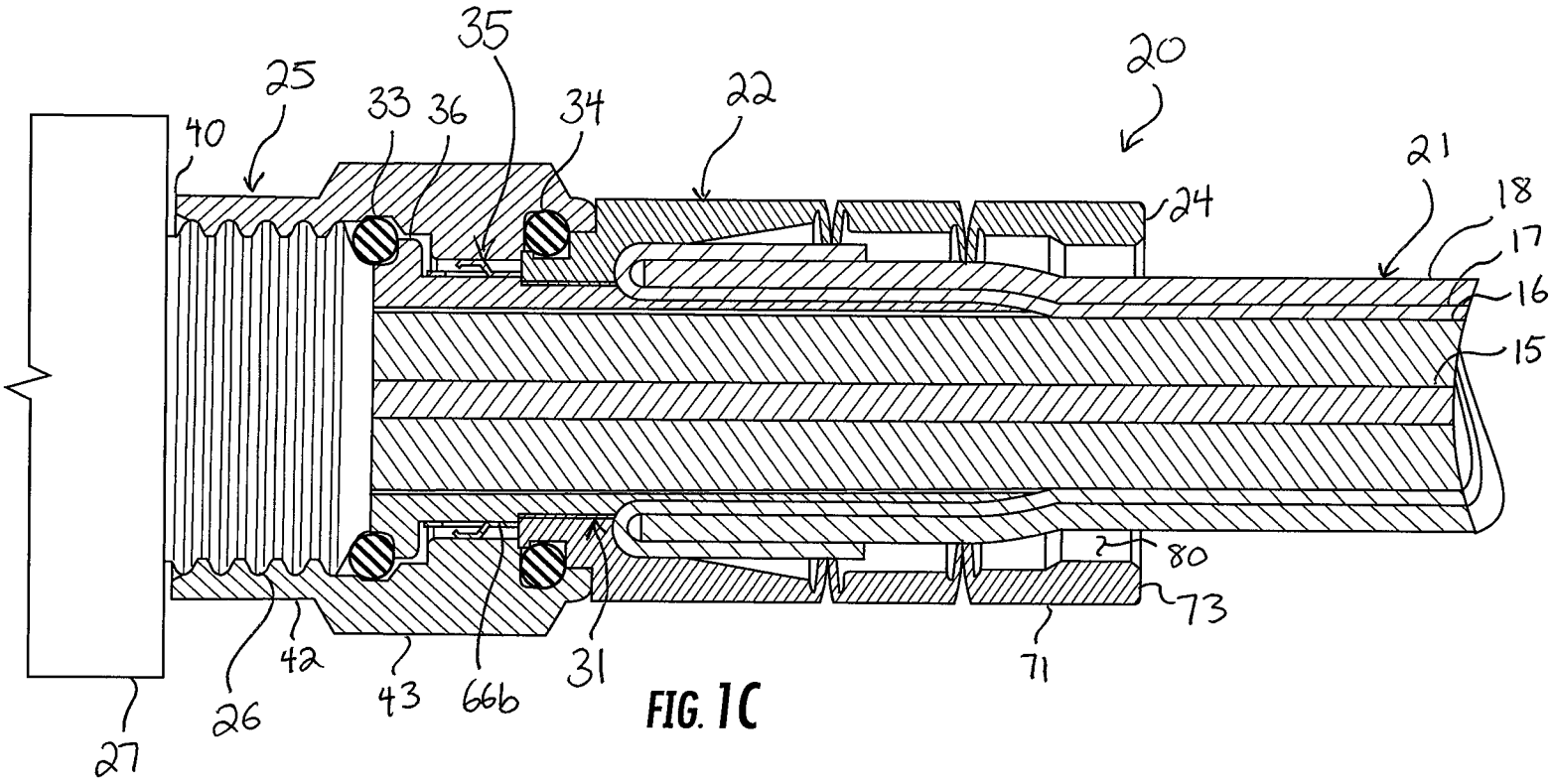
FIG. 1C is a partial section view bisecting the coaxial cable connector of FIG. 1A, showing the connector applied to a mating port of an electronic component.

Reference now is made to the drawings, in which the same reference characters are used throughout the different figures to designate the same elements. FIGS. 1A-1C illustrates a coaxial cable connector 20 which effectively establishes and maintains electrical continuity without the need for tightening, compressing, or otherwise forcing the connector 20 or parts thereof. FIG. 1A illustrates the connector 20 before it is installed on a cable 21 and in an uncompressed condition, FIG. 1B illustrates the connector installed on the cable 21 and in a compressed condition, and FIG. 1C illustrates the connector installed on the cable 21 and applied to a mating port 26 of an electronic component 27. The embodiment of the connector 20 shown throughout the drawings is an F connector for use with an RG6 coaxial cable for purposes of example, but it should be understood that the description below is also applicable to other types of coaxial cable connectors and other types of cables.

The connector 20 includes a body 22 having opposed front and rear ends 23 and 24, a coupling nut 25 mounted for rotation on the front end 23 of the body 22, and an inner post 31. The connector 20 has rotational symmetry with respect to a longitudinal axis A illustrated in FIG. 1A. The connector 20 is for crimping onto the cable 21, which includes an inner conductor 15 which, when applied to the connector 20, extends into the connector 20 from the rear end 24 in the applied condition of the connector 20. The inner conductor 15 extends through the connector 20 and projects beyond the nut 25, as shown in FIG. 1B.

The nut 25 is carried on a front end 32 of the inner post 31. The front end 32 of the inner post 31 terminates in an outwardly directed flange 36. The nut 25 rides on two gaskets 33 and 34 disposed between the nut 25 and the inner post 31. The gaskets 33 and 34 are slightly compressed, ensuring a fluid impervious seal between the nut 25 and the inner post 31 so that water and other fluids cannot enter the connector 20 or the cable 21 through the connector 20.

Also disposed between the nut 25 and the inner post 31 is a continuity member 35. The continuity member 35 is radially disposed between the nut 25 and the inner post 31 and maintains an electrical continuity B between the nut 25 and the inner post 31 regardless of application on a port, tightness, compression, rotation, tugging, bending, or other movement of the connector 20 or the cable 21, or the lack of such. The continuity member 35 is constructed and configured to maintain the electrical continuity B between the nut 25 and the inner post 31, as will be described herein.

Figure 2:
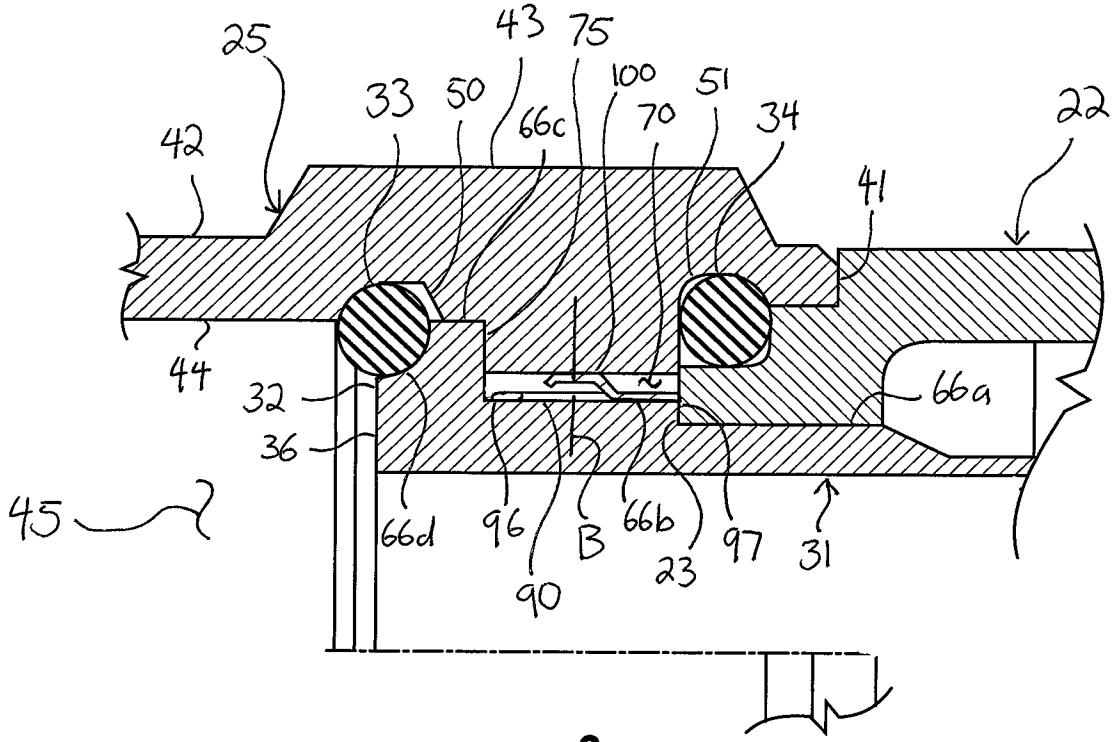
FIG. 2 is an enlarged view of a portion of the continuity member disposed between a coupling nut and a post of the coaxial cable connector of FIG. 1A.

FIG. 2 shows a portion of the connector 20 in section view. The nut 25 is a sleeve having opposed front and rear ends 40 and 41, an integrally-formed ring portion 42 proximate to the front end 40, and an integrally-formed nut portion 43 proximate to the rear end 41. The nut portion 43 is mounted at the front end 23 of the body 22 on the post 31 for rotation about axis A, so that the entire nut 25 is mounted for free rotation on the post 31. The ring portion 42 has a smooth annular outer surface and an opposed threaded inner surface for engagement with an electronic component 27. Briefly, as a matter of explanation, the phrase "electronic component," as used throughout the description, includes any electrical device having a female post or mating port 26 to receive a male coaxial cable connector 20 for the transmission of RF signals such as cable television, satellite television, internet data, and the like. The term "electronic component" specifically includes wall jacks, wall installations, exterior cable box hookups. The nut portion 43 of the nut 25 preferably has a hexagonal outer surface to receive the jaws of a tool and an opposed grooved inner surface 44 to receive the gaskets 33 and 34 and to engage with the body 22 of the connector 20. An interior space 45 extends into the nut 25 from a mouth formed at the front end 40 of the nut 25, to an opening formed at the rear end 41, and is bound by the inner surface of the ring portion and the inner surface 44 of the nut portion 43. Two annular channels 50 and 51 extend from the interior space 45 into the nut portion 43 from the inner surface 44 annularly and continuously around the nut portion 43. The nut 25 is constructed of a material or combination of materials having strong, hard, rigid, durable, and high electrically-conductive material characteristics, such as metal.

Referring back to FIG. 1A, the body 22 of the connector 20 is an assembly including a cylindrical outer barrel 60 and the cylindrical, coaxial inner post 31 disposed within the outer barrel 60. The inner post 31 is an elongate sleeve extending along axis A and having rotational symmetry about axis A. The inner post 31 has opposed front and rear ends 32 and 63 and opposed inner and outer surfaces 64 and 65. The outer surface 65 at the rear end 63 of the inner post 31 is formed with several annular ridges 66 projecting toward the front end 32 and extending radially outward from axis A. As the term is used here, "radial" means directed, extending, or aligned along a radius extending from the axis A normal to the axis. Moreover, the term "axial" means directed, extending, or aligned parallel to the axis A. Still further, the terms "forward," "ahead," and the like are used to generally indicate a direction toward the front end 40 of the nut, and the terms "rearward," "behind," and the like are used to generally indicate a direction toward the rear end 24 of the body 22. The ridges 66 are spaced apart from each other along the rear end 63 of the inner post 31. The ridges 66 provide grip on the cable 21 when applied to the coaxial cable connector 20 to hold the cable 21 and prevent the cable 21 from backing out of the connector 20.

Now referring again to the enlarged view of FIG. 2, the outer surface 65 of the inner post 31 is formed with a stepped series of outwardly-directed annular faces 66*a*, 66*b*, 66*c*, and 66*d*, spaced apart sequentially and axially along the inner post 31 proximate to the front end 32. Each face 66*a*-66*d* has a similar structure and projects and is oriented radially away from the axis A. Each of the faces 66*a*-66*d* extends to a different radial distance away from the axis A, and so defines a ring or annular extension of the inner post 31 with a unique diameter. The face 66*a* has a first diameter, the face 66*b* has a second diameter greater than the first diameter of the face 66*a*, the face 66*c* has a third diameter greater than the second diameter of the face 66*b*, and the face 66*d* has a fourth diameter less than the third diameter of the face 66*c* but greater than the second diameter of the face 66*b*. The body 22 is coupled to the inner post 31 at the face 66*a*.

Just ahead of the front end 23 of the body 20 is a toroidal volume 70 defined between the face 66*b* and the inner surface 44 of the nut 25. The toroidal volume 70 has a long dimension in the axial direction compared to a short dimension in the radial direction; thus, the toroidal volume defines a very thin toroid. In profile, the toroidal volume 70 has a rectangular cross-section, as shown in FIGS. 1A, 1B, 1C, and 2, and is aligned so that its long dimension is parallel to the axial direction and its short dimension is parallel to the radial direction.

One bounding side of the short dimension of the toroidal volume 70 is defined by the inner surface 44 of the nut 25. The opposing bounding side of the short dimension is defined by the face 66*b* of the inner post 31. One bounding side of the long dimension is defined by a rear face 75 of the flange 36 on the inner post 31 between the faces 66*c* and 66*d*. The opposing bounding side of the short dimension is defined by the front end 23 of the body 22. The gaskets 33 and 34 are located between the nut 25 and the inner post 31 in front of and behind the toroidal volume 70, and just beyond the toroidal volume 70 in a radial direction. The nut 25 is supported and carried on the inner post 31 by the gaskets 33 and 34, and the gaskets 33 and 34 prevent the introduction of moisture into the connector 20. The inner post 31 is constructed of a material or combination of materials having hard, rigid, durable, and high electrically-conductive material characteristics, such as metal, and the ring gaskets 73 and 81 are constructed from a material or combination of materials having deformable, resilient, shape-memory material characteristics. The continuity member 35 is disposed within the toroidal volume 70, is in contact with the inner surface 44 of the nut 25 and the face 66*b* of the inner post 31, which are radially opposed to each other across the toroidal volume 70.

Returning now back to FIG. 1A, the outer barrel 60 is an elongate, cylindrical sleeve extending along axis A with rotational symmetry about axis A. The outer barrel 60 has a sidewall 71 with opposed front and rear ends 72 and 73 and an inner surface 74 and opposed outer surface. The inner surface 74 defines and bounds an interior cable-receiving space 80 shaped and sized to receive the coaxial cable, and in which the rear end 63 of the inner post 31 is disposed. An opening at the rear end 73 of the outer barrel 60 communicates with and leads into the cable-receiving space 80. The front end 72 of the outer barrel 60 is formed with an inwardly projecting annular lip 81. The lip 81 abuts and is received against the face 66*a* in a friction-fit engagement, securing the outer barrel 60 on the inner post 31. The lip 81, together with the front end 23 of the body and the rear end 41 of the nut 25, define a very narrow circumferential groove extending into the connector 20 from the outer surface of the outer barrel 60. The outer barrel 60 is constructed of a material or combination of materials having strong, rigid, size- and shape-memory, and electrically-insulative material characteristics, as well as a low coefficient of friction, such as plastic or the like.

Referring again to the enlarged view of FIG. 2, the nut 25 is mounted for free rotation on the inner post 31 about the axis A. To allow free rotation, the gaskets 33 and 34 space the nut portion 25 just off the inner post 31 in a radial direction, defining the toroidal volume 70, and allowing for slight movement in the radial direction, allowing slight torsional bending of the nut 25 and outer barrel 60 on the inner post 31 along the axis A, and allowing the nut 25 to rotate with low rolling friction on the gaskets 33 and 34. When the nut 25 is carried on the body 22 and is threaded onto or coupled to a mating port 26 of an electronic component 27, the nut 25 generally provides a secure, stable fixture supporting the inner post 31 and the outer barrel 60.

The continuity member 35 is disposed radially in the toroidal volume 70 and maintains electrical continuity B between the coupling nut 25 and the post 31 regardless of whether the connector 20 is applied to a mating port 26 of an electronic component 27 or not. In other words, the continuity member 35 maintains the electrical continuity B when the connector 20 is free of the mating port 26 (as in FIG. 1B) and also when the connector 20 is applied to the mating port 26 (as in FIG. 1C). Further, electrical continuity B is maintained even before the connector 20 is applied to the cable 21 (as in FIG. 1A); the unique construction, configuration, and arrangement of the continuity member 35 establishes and maintains the electrical continuity B between the nut 25 and the post 31 without the need for compression of the continuity member 35 in addition to that with which the continuity member 35 is pre-loaded. Thus, electrical continuity B is maintained regardless of compression, a level of compression, or the total lack of compression beyond pre-loading, radial, axial, or otherwise. For purposes of clarity, the "electrical continuity" is defined as a connection or union from the coupling nut 25 to the post 31 that is continuous and through which the passage of an electrical signal, such as an RF signal, is facilitated. The electrical continuity B is depicted visually in FIG. 2 as a line extending radially from the coupling nut 25, through the continuity washer 35, to the inner post 31. The continuity member 35 has a plurality of electrical continuities each extending in a radial direction only, as will be explained.

Figure 3C:
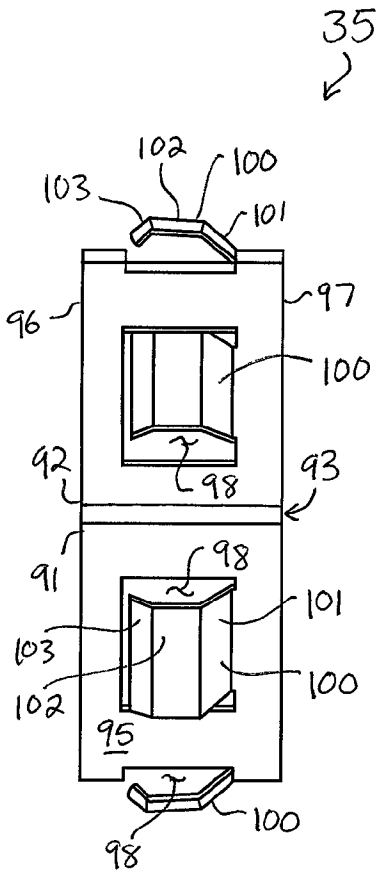
FIGS. 3A, 3B, 3C are perspective, top plan, and side elevation views, respectively, of an embodiment of the continuity member of FIG. 1A.
Figure 3B:
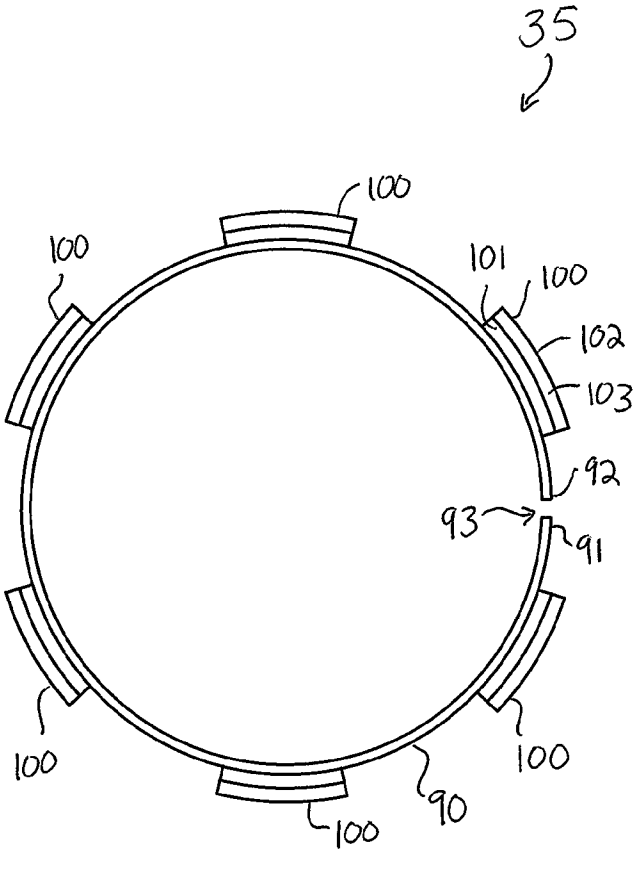
Figure 3A:
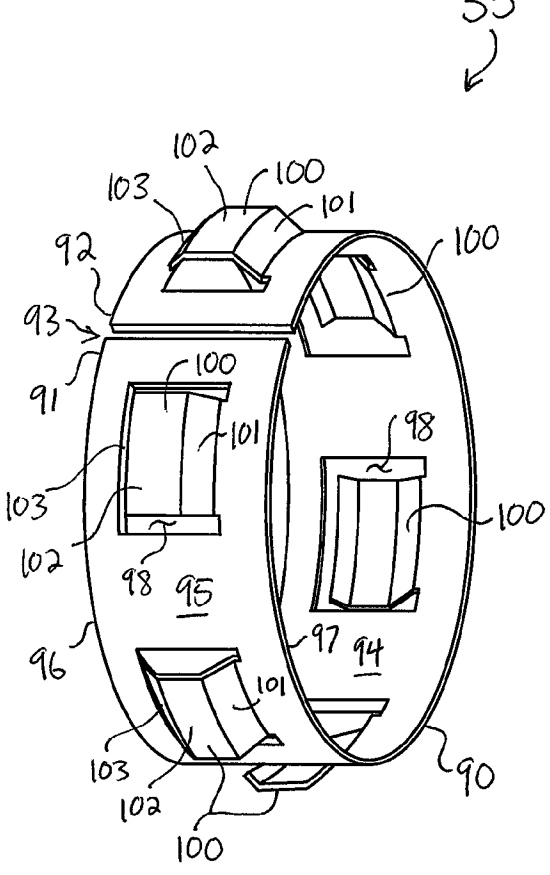

Turning now to FIGS. 3A-3C, one embodiment of a continuity member is illustrated in isolation in perspective, top plan, and side elevation views, respectively. The embodiment shown in FIGS. 3A-3C is the same as that shown in FIGS. 1A-2, and so the reference character 35 is used to identify that same element.

The continuity member 35 establishes, ensures, and maintains continuity during any flexing or bending of the connector 20 or the cable 21 behind it. The continuity member 35 does this by maintaining contact despite bending, shifting, or moving otherwise. The continuity member 35 also maintains electrical continuity B without the need for being compressed against any other part of the connector 20. The continuity member 35 is formed from a single piece of sheet metal having the material properties of good electrical conductivity, good resiliency, and good shape memory. The continuity member 35 includes a body 90 formed or bent into an annulus so as to generally define an annular body. The annular body 90 has opposed ends 91 and 92, which in the embodiment shown in FIGS. 3A-3C are blunt and squared-off, and the annular body 90 has a length which is bent into a circumference. The ends 91 and 92 are spaced apart when the body 90 is bent into its annular shape, thereby defining a thin axially-directed gap 93 so that the continuity member 35 has the form of a severed ring. The continuity member 35 includes an inner face 94 and an opposed outer face 95. Both the inner and outer faces 94 and are substantially smooth but for the formation of a plurality of fingers 100 which project from the body 90.

The annular body 90 maintains contact in a radially inward direction with the face **66*b* of the inner post 31, and each of the fingers maintains contact in a radially outward direction with the inner surface 44 of the nut 25, cooperating so as to maintain the electrical continuity B between the coupling nut 25 and the inner post 31. The fingers 100 are die-cut or punched and bent from the body 90 itself, preferably while the body 90 is still laid flat before it is rolled or bent in the illustrated annular shape. The fingers 100 are formed integrally and monolithically with the annular body 90, such that they are integral extensions of the annular body 90. In this way, a single piece of material is cut, then punched to form the fingers 100, then bent into the annulus shape of the continuity member 35, providing an effective and efficient method for forming the continuity member 35. In the embodiment shown in FIGS. 3A-3C, there are six fingers 100; in other embodiments, there may be a greater or fewer number of fingers 100, however, there preferably are at least three fingers 100 so that the fingers 100 define an outer perimeter for contacting the inner surface 44 of the nut 25 without the inner surface 44 of the nut 25 contacting the outer face 95 of the continuity member 35. The fingers 100 are spaced circumferentially apart from each other about the annular body 90**.

All of the fingers 100 are identical in every structural respect other than location on the annular body 90. As such, the following description will refer to only one of the fingers 100, with the understanding that the description applies equally to each and every other finger 100. Additionally, the reference character 100 is used to identify each finger 100 without distinction. The finger 100 is a wide raised element projecting of the annular body 90 extending axially forwardly from proximate to the rear of the face 97 of the continuity member 35, and is bent into three portions. The finger 100 extends over a rectangular hole 98 located generally intermediate in the annular body 90. A first portion defines a fixed end 101 which is formed integrally and monolithically to the body 90. A second portion defines an intermediate portion 102 which is formed integrally and monolithically to the fixed end 101. A third portion defines a free end 103 which is formed integrally and monolithically to the intermediate portion 102. The fixed end 101 is wide and flat, and extends obliquely away from the outer face 95. The intermediate portion 102 is wide and flat, extends obliquely away from the fixed end 101, and is generally parallel to the outer face 95. The free end 103 is wide and flat, is free, extends obliquely away from the intermediate portion 102, and extends toward the outer face 95. The free end 103 is spaced apart from the outer face 95 axially and radially, however. The finger 100 thus has an outwardly convex profile from the fixed end 101 to the free end 103, where the finger 100 first bends arcuately away and then back toward the annular body from the fixed end 101 to the free end 103. The fixed and free ends 101 and 103 are aligned equally and oppositely to each other.

The body 90, being formed of a material or combination of materials having good resiliency and shape memory characteristics, maintains its shape. The fingers 100, being formed integrally and monolithically to the body 90, are constructed of the same material or combination of materials and also have good resiliency and shape memory characteristics. The fingers 100 extend out beyond the outer face 95 of the continuity member 35 and resist inward compression. Therefore, the fingers 100 exert a bias radially outward in opposition to inward radial compression.

Before assembly of the connector 20, and before the continuity member 35 is applied to the post 31 and under the coupling nut 25, the fingers 100 are uncompressed and the continuity member 35 is unloaded. During assembly, the continuity member 35 is placed over the inner post 31 and the coupling nut 25 is placed over the continuity member 35. The continuity member 35 is pre-loaded with a force, namely, a radial force. "Pre-loaded" is used to describe a force, such as a spring force, that the continuity member 35 is placed under during assembly and which is maintained during normal use and operation of the continuity member 35; any other forces exerted on the continuity member 35 during operation would be additional forces in excess of this pre-loaded force. In some embodiments of the connector 20, the diameter of the inner post 31 is larger than the unloaded diameter of the annular body 90 of the continuity member 20; the annular body 90 will thus be expanded, is placed under tension, and exerts a compressive force on the face **66*b* of the inner post 31 in the radial direction only. In this context, the annular body 90 is pre-loaded with a compressive force. In other embodiments of the connector 20, the diameter of the inner post 31 is smaller than the unloaded diameter of the annular body 90 of the continuity member 35; the annular body 90 will rotate freely until the coupling nut 25 is applied over the continuity member 35. Once the coupling nut 25 is placed over the continuity member 35, however, the inner surface 44 of the nut 25 compresses the continuity washer 35 in the radial direction only, thereby causing the annular body to constrict and exert an expansive force in the radial direction only. In this context, the annular body 90** is pre-loaded with an expansive force in the radial direction only.

In either embodiment, whether the diameter of the inner post 31 at the face 66*b* is slightly smaller or larger than the diameter of the annular body 90, the annular body 90 is pre-loaded with a radial force. It retains and maintains this pre-loaded radial force throughout its life; the force does not change when the connector 20 is free of the cable 21, when the connector 20 is applied to the cable 21, when the connector 20 is applied to the mating port 26 loosely, or when the connector 20 is applied to the mating port 26 tightly. This pre-loaded force on the annular body 90 is slight, but is sufficient to provide a very light friction fit with the inner post 31, such that the continuity member is unlikely to move axially: it generally remains in place in a rear position of the toroidal volume 70 set back from the flange 36 of the inner post 31 and is not acted upon by axial compressive forces because the annular body has an axial clearance in the toroidal volume 70, as described below. The small amount of pre-loaded radial force on the continuity washer 35 is sufficient to create a light friction fit limiting axial movement, and the continuity washer 35 need not be axially translated or compressed against the flange 36 at the front end 32 of the inner post 31 to maintain the electrical continuity B.

Similarly to the annular body 90, the fingers 100 are pre-loaded with a compressive force in the radial direction only. When disposed in the toroidal volume 70, the fingers 100 are slightly compressed inwardly in a radial direction. The unique outwardly convex profile of the fingers 100 allows them to deform and be displaced in a radial direction alone. The intermediate portion 102 of the finger 100, being substantially parallel to the outer surface 95 of the annular body 90, is also substantially parallel to the inner surface 44 of the coupling nut 25 and is the only portion of the finger 100, and indeed, of the continuity member 35, which makes contact with the coupling nut 25. Thus, the inner surface 44 encounters and compresses the parallel intermediate portion 102 of the finger 100 once the connector 20 is assembled. This pre-loaded compression is in the radial direction only, by virtue of the compression between the two parallel forces which are parallel to the longitudinal axis A. No portion of the compression of the finger 100 is in the axial direction or in another direction other than radial.

This radial-only compression uniquely allows the continuity member 35 to freely rotate, preferably in synch with or together with the coupling nut 25 (though not necessarily otherwise), even when the coupling nut 25 is tightened onto the mating port 26 of an electronic component 27 and yet still maintain the electrical continuity B between the nut 25, the continuity member 35, and the inner post 31. The smooth inner surface 94 of the continuity member 35 allows the continuity member 35 to rotate freely on the smooth face 66*b* of the inner post 31. The inner surface 94 of the continuity member 35 is always in contact with the face 66*b*, so that the continuity member 35 maintains contact and maintains the electrical continuity B with and between the nut 25 and the inner post 31, and also maintains the electrical continuity B in a radial direction only.

When the continuity member 35 is disposed in the toroidal volume 70, the continuity member 35 maintains the electrical continuity B in the radial direction only because of the unique shape and placement of the continuity member, as well as the unique arrangement of the structure elements and features of the connector 20. The electrical continuity B is oriented in the radial direction only between the coupling nut 25 and the continuity member 35, and is oriented in the radial direction only between the continuity member 35 and the post 31. The continuity member 35 has the annular body 90 and the fingers 100. The annular body touches only the face 66*b* of the inner post 31 and the front end 23 of the body 22. The flange 36 is integral to the inner post 31, with which the annular body 90 is already in contact. In an embodiment of the connector 20 in which the body 22 is plastic, the front end 23 of the body 22 is insulative. And in an embodiment of the connector 20 in which the body 22 is metal, because there is no compressive force in the axial direction, the continuity member 35 experiences enough axial drift that contact with the body 22 is not reliable. Thus, there can be no axial component of electrical continuity rearwardly; an axial component would pass signal through a rear end 97 of the continuity member 35 to the body 22, but the body is non-conductive for signal transmission. And, as shown in FIG. 2, a front end 96 of the continuity member 35 is spaced apart from the rear face 75 of the flange 36 and thus not in electrical communication with it. There can thus be no axial component of electrical continuity forwardly, either. As such, the only path for an RF signal to travel along through the continuity member 35 is a radial one, from the inner surface 44 of the coupling nut 25, through the finger 100 of the continuity member 35, through the annular body 90 of the continuity member 35, and then through the face 66*b* and into the inner post 31.

This maintenance of contact and electrical continuity B with and between the nut 25 and the inner post 31 is unique in that it does not depend on the exertion or existence of any axial forces between any of the body 22, nut 25, or inner post 31. The connector 20 maintains contact and electrical continuity B without relying on axial forces. Indeed, the continuity member 35 exerts no axial forces on the body 22, the coupling nut 25, or the post 31, and the body 22, the coupling nut 25, and the post 31 do not exert axial forces on the continuity member 35. Further, the continuity member 35 exerts no radial forces on the body 22, the coupling nut 25, or the post 31 in addition to those that the continuity member 35 is pre-loaded with during assembly of the connector 20. Likewise, the body 22, the coupling nut 25, and the post 31 do not exert any radial forces in addition to those already exerted as a result of the assembly of the connector 20. In short, no radial or axial compressive forces are applied to or from the continuity member in addition to the pre-loaded radial compressive force between the coupling nut 25 and the continuity member 35. Electrical continuity is maintained regardless of an axial, radial, or other compressive force (or lack thereof) on the continuity member 35 other than the pre-loaded radial compressive force applied during assembly.

If the connector 20 does bend or flex, the continuity member 35 experiences no axial force from either the coupling nut 25 or the inner post 31. Continuity of the RF signal is maintained regardless of bending of the connector 20 or the cable, and is regardless of any irregular contact or installation of the connector 20 itself. Continuity is therefore less dependent on a perfect, or near perfect, installation of the connector 20 by a technician on a cable 21 and mating port 26 of an electronic component 27.

As described above, the continuity member 35 is disposed within the toroidal volume 70 and has some axial clearance therein which helps prevent binding by the coupling nut 25. The annular body 90 of the continuity member 35 has the front end 96 and the opposed rear end 97, which are proximate the flange 36 and the front end 23 of the body 22, respectively, at the front and back of the toroidal volume 70.

The distance between the front and rear ends 96 and 97 is a height of the continuity member 35 and is just less than the axial length of the face 66*b*, such that the annular body 90 is shorter than the face 66*b* and the continuity member 35 could possibly slide or reciprocate very slightly in an axial direction in the toroidal volume 70, but for the slight friction fit described above. The annular body 90 is flat along this axial direction, is rigid, and is not in contact with both the flange 36 at the front end 32 of the inner post 31 and the front end 23 of the body 22, such that the continuity member 35 exerts no spring force and no compressive force along the axial direction. Rather, the annular body 90 remains relatively incompressible and inert.

As explained above, the fingers 100 are capable of flexing in a radial direction, but flexion is generally limited to that as a result of the fingers 100 being pre-loaded with a compressive radial force during assembly. As such, when the coupling nut 25 is mounted on the inner post 31, the continuity member 35 exerts no axial force on the body 22, nut 25, or the inner post 31. Because the continuity member 35 is not compressed axially between the nut 25 and the post 31, nor between the post 31 and the body 22, nor between the nut 25 and body 22, it exerts an axial force on none of these elements. Without exerting any axial forces on the nut 25, the nut 25 remains nearly free of rotational friction from the continuity member 35, and thus is very easy to spin on the inner post 31, requiring very little torque. The connector 20 thus has a very low free nut torque requirement: unlike conventional connectors, only low torque is required to rotate the nut 25 on the inner post 31, regardless of the application of the connector 20, i.e., regardless of whether the connector 20 is applied on the mating port 26 of an electronic component 27 or not. Explained in another way, in a first state of the coupling nut 25 characterized by the coupling nut 25 being free of the mating port 26 of an electronic component 27, very low torque is required to freely rotate the coupling nut 25 on the inner post 31, and the electrical continuity B is maintained between the coupling nut 25 and the post 31. The first state of the coupling nut 25 is shown in both FIG. 1A and FIG. 1B. In a second state of the coupling nut 25 characterized by the coupling nut 25 being applied—either loosely or tightly—to the mating port 26 of the electronic component 27, very low torque is still required to freely rotate the coupling nut 25 on the inner post 31, and the electrical continuity B is maintained between the coupling nut 25 and the post 31. The second state of the coupling nut 25 is illustrated in FIG. 1C. Straightforwardly, very low torque is also required to move the coupling nut 25 from the first state to the second state. Notably, the orientation, arrangement, and displacement of the fingers 100 does not change from FIG. 1A to FIG. 1B to FIG. 1C: because no additional compression is exerted on the fingers 100, the fingers 100 maintain their displacement through the first and second states.

Briefly, referring to FIGS. 1A and 1B, the outer barrel proximate to the rear end 73 defines an integral compression collar which compresses axially and deforms radially inward in response to being compressed axially. The sidewall 71 of the outer barrel 60 has two areas of reduced thickness near the rear end 73, defining first and second compression bands 82 and 83. The first and second compression bands 82 and 83 are identical to each other in every respect except axial location on the outer barrel 60, and as such, only the first compression band 82 will be described, with the understanding that the description applies equally to the second compression band 83 accounting for the difference in axial location. With reference now to FIG. 1 primarily, the first compression band 82 includes a first wall, a second wall, and a bend formed therebetween. The first and second walls project radially inward toward from the axis A. The first wall is formed proximate to the rear end 73, the second wall is formed forward of the first wall, and the bend is a flexible, thin, annular portion of the sidewall 71 between the first and second walls, defining a living hinge therebetween. The first and second walls are oblique when the outer barrel 60 is in an uncompressed condition, and converge toward each other. A V-shaped channel is thus defined between the first and second walls. When the connector 20 is compressed axially, such as would occur when it is placed in a compression tool for application onto the cable, the first and second walls collapse and move into each other, causing the bend to flex, urging it radially inward toward the inner post 31.

In operation, the cable connector 20 is useful for coupling a coaxial cable 21 to a post of an electronic component 27 in electrical communication so as to maintain continuity but also ease installation and minimize concerns of future accidental decoupling from the mating port 26. To do so, the coaxial cable 21 is conventionally prepared to receive the cable connector 20 by stripping off a portion of a jacket of the coaxial cable 21 to expose an inner conductor 15, a dielectric insulator 16, a foil layer 17, and a flexible jacket 18. The dielectric insulator 16 is stripped back to expose a predetermined length of the inner conductor 15, and the end of the foil layer 17 is turned back to cover a portion of the jacket. The end of the coaxial cable 21 is then introduced into the connector 20 to arrange the connector 20 in an uncompressed condition, as shown in FIG. 1A. The coaxial cable 21 is shown only in FIGS. 1B and 1C, for clarity of the other illustrations, and because one having ordinary skill in the art will readily appreciate how the cable 21 is applied to the connector 20 after reading the following description.

To arrange the connector 20 from a uncompressed free condition of FIG. 1A into the uncompressed condition on the coaxial cable 21, the prepared coaxial cable 21 is aligned with the axis A and passed into the cable-receiving space 80 bound by the inner post 31, ensuring that the inner conductor 15 is aligned with the axis A. The coaxial cable 21 continues to be moved forward until the coaxial cable encounters the rear end 63 of the inner post 31, where the jacket is advanced over the rear end 63 and the ridges 66 are placed in contact with the foil layer 17, and the portion of the foil layer 17 turned back over the jacket is in contact with the inner surface 74 of the outer barrel 60. The foil layer 17 and the dielectric insulator 16 are also advanced forward within the inner post 31 against the inner surface 64 of the inner post 31. Further forward movement of the coaxial cable 21 advances the coaxial cable so that a free end of the dielectric insulator 16 is disposed within the nut portion 43 of the nut 25 and the inner conductor 15 extends through the interior space 45 of the ring portion 42 and projecting beyond the opening of the nut 25. In such an arrangement, the foil layer 17 is in contact in electrical communication with the outer surface 65 of the inner post 31. Further, the foil layer 17 is also in electrical communication with the nut 25 through the inner post 31, establishing shielding and grounding continuity between the connector 20 and the coaxial cable, as shown in FIG. 7. With reference specifically to FIG. 1A, in the uncompressed condition of the connector 20, the connector 20 has a first length from the front end 23 to the rear end 24.

From the uncompressed condition, the connector 20 is moved into the compressed condition illustrated in FIG. 1B. The thin-walled first and second compression bands 82 and 83 of the outer barrel 60 are useful for crimping down on the coaxial cable 21 to provide a secure, non-damaging engagement between the connector 20 and the coaxial cable 21. To compress the connector 20, the connector 20 is placed into a compressional tool which grips the connector 20 and compresses the connector 20 axially along the axis A from the front and rear ends. The axial compressive forces subject the thinned sidewalls of the outer barrel 60 at the first and second compression bands 82 and 83 to stress, urging each to deform and bend in response to the stress.

As the compression tool operates, in response to the applied axial compressive force, the rear end 73 of the outer barrel 60 is advanced toward the front end 72 of the outer barrel 60, causing the outer barrel 60 to compress at the first and second compression bands 82 and 83, respectively. The oblique walls of the first and second compression bands 82 and 83 are each oblique to the applied force and are transverse to the other wall in the first or second compression band 82 or 83. The first and second compression bands 82 and 83 buckle radially inward, forming two V-shaped channels inwardly.

Compression continues until the first and second compression bands 82 and 83 are closed such that there is essentially no space between the oblique walls of the first and second compression bands 82 and 83, as shown in FIG. 1B. The connector 20 is thus placed in the compressed condition. Although the process of moving the connector 20 from the uncompressed condition to the compressed condition is presented and described above as a series of sequential steps, it should be understood that the compression of the connector 20 on a coaxial cable is preferably accomplished in one smooth, continuous motion, taking less than one second.

In the compressed condition of the connector 20, the first length of the connector 20 from the front end 23 to the rear end 24 is now a second length, which is less than the first length of the uncompressed condition. Other embodiments, such as would be used with other types of cables, will have different dimensions. This significant reduction in diameter causes the jacket 18 and the foil layer 17 of the coaxial cable to become engaged and crimped between the first and second compression bands 82 and 83 and the inner post 31. Moreover, the first and second compression bands 82 and 83 are opposed from the ridges 66 of the inner post 31, thereby preventing withdrawal of the coaxial cable from the connector 20.

The rigid material characteristics of the inner post 31 prevent the inner post 31 from being damaged by the crimping. Furthermore, because the dielectric insulator 16 and inner conductor 15 are protected within the inner post 31 and the foil layer 17 is outside the inner post 31 in contact with the outer surface 65 of the inner post 31, the continuity of the connection between the foil layer 17 and the inner post 31 is maintained so that a signal transmitted through the connector 20 is not leaked outside of the connector 20, so that outside RF interference does not leak into the connector 20, and so that the connector 20 remains electrically grounded. The interaction between the foil layer 17 and the ridges 66, which project forwardly and radially outward from axis A, further inhibits movement of the coaxial cable rearward out of the connector 20, ensuring that the connector 20 is securely applied on the coaxial cable. With the connector 20 in the compressed condition as in FIG. 1B, the connector 20 can now be coupled to a mating port 26 of an electronic component 27 in a common and well-known manner by threading the connector 20 onto a threaded mating port 26 of a selected electronic component 27. It is noted that that FIG. 1C shows the coupling nut 25 as having internal threads engaged with a mating port 26; FIGS. 1A and 1B show the connector 20 without those threads to illustrate a slightly different embodiment. One having ordinary skill in the art will readily appreciate the minor difference between the two and will understand that the difference does not affect the functionality of the connector 20.

Once applied to an electronic component 27, the connector 20 may be twisted, rotated, bent, flexed, or otherwise moved, without risking the electrical continuity B. While such movements might break electrical continuity of other connectors, the continuity member 35, at least, prevents loss of the electrical continuity B. The continuity member 35 is maintained in a partially compressed state due to the preloading of the continuity member 35 during assembly, with the fingers 100 compressed slightly radially inward by the coupling nut 25. The fingers 100 are resilient and sprung, and bias radially outwardly against the coupling nut 25. This causes the intermediate portion 102 of the fingers 100 to be constantly under a force in the radial direction only, constrained by the coupling nut 25, as described above.

Figure 4C:
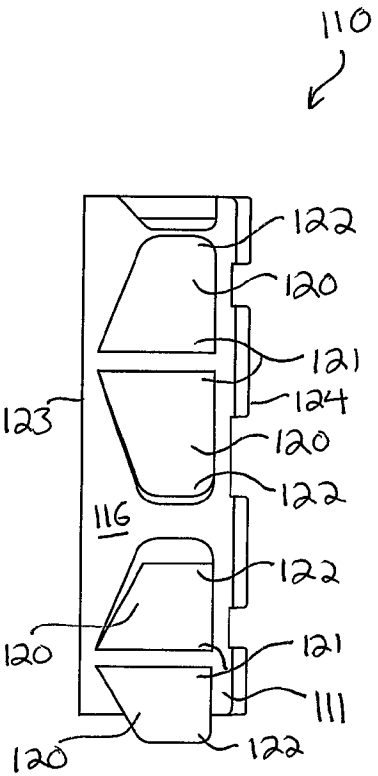
FIGS. 4A, 4B, 4C are perspective, top plan, and side elevation views, respectively, of another embodiment of the continuity member of FIG. 1A.
Figure 4B:
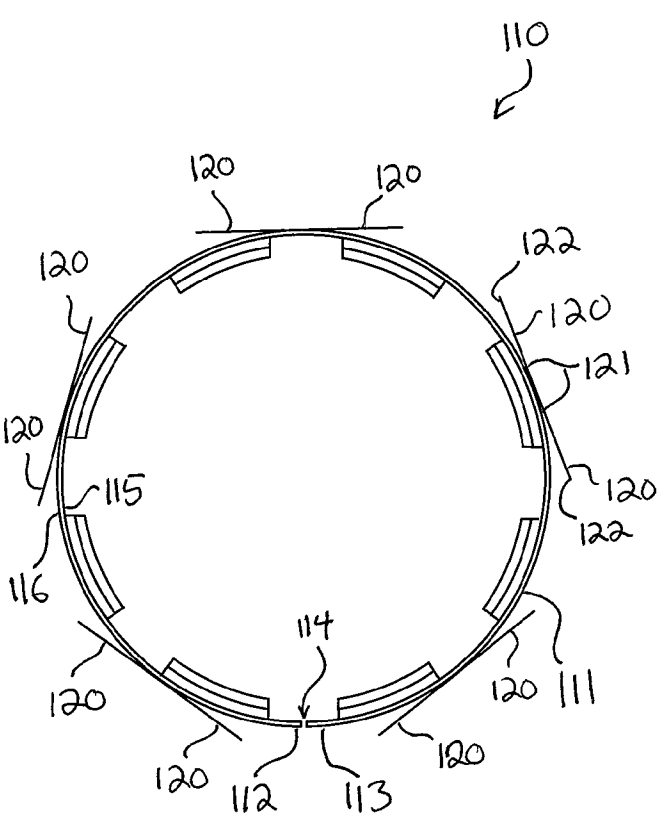
Figure 4A:
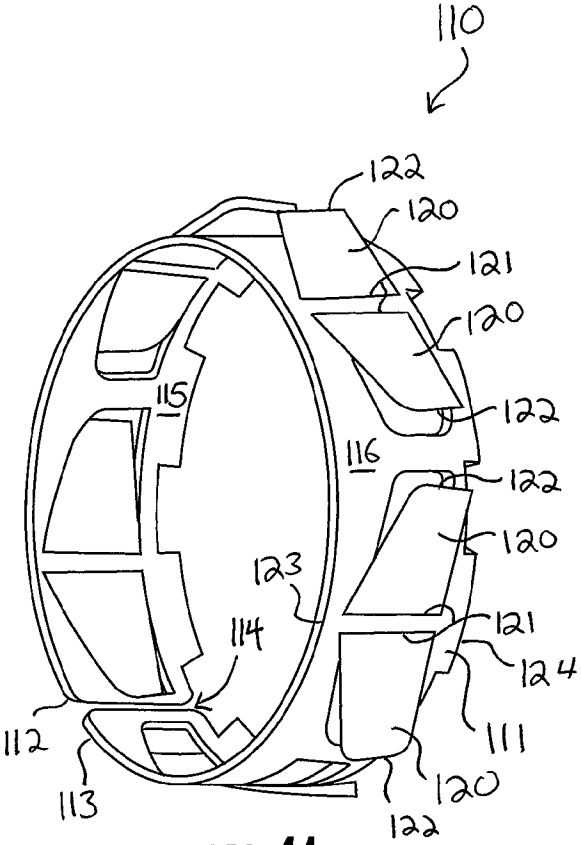

In other embodiments of the connector 20, alternate continuity members are used. Turning to FIGS. 4A-4C, a continuity member 110 is shown in perspective, top plan, and side elevation views. The continuity member 110 is easily substituted into the connector 20 in place of the continuity member 35 shown in FIGS. 1A-3C. This embodiment of the continuity member 110 is formed from a single piece of sheet metal having the material properties of good electrical conductivity and good resiliency and shape memory. The continuity member 110 includes a body 111 bent into an annular shape so as to generally define an annular body 111. The annular body 111 has opposed ends 112 and 113, which in the embodiment shown in FIGS. 4A-4C are blunt and squared-off, and has a length which is rolled or bent into a circumference. The ends 112 and 113 are spaced apart when the annular body 111 is bent into an annulus, thereby defining a thin gap 114 so that the continuity member 110 is a severed ring. The continuity member 110 includes an inner face 115 and an opposed outer face 116. Both the inner and outer faces 115 and 116 are substantially smooth but for the formation of a plurality of wings 120 which extend from the annular body 111.

The wings 120 are die-cut or punched and bent from the annular body 111 itself. The wings 120 are formed integrally and monolithically with the annular body 111. In this way, a single piece of material is cut, then punched to form the wings 120, then bent into the annulus shape of the continuity member 110, providing an effective way to form the continuity member 110. The wings 120 are grouped in pairs or sets. In the embodiment shown in FIGS. 4A-4C, there are five sets of two wings 120; in other embodiments, there may be a greater or fewer number of wings 120, however, there preferably are at least eight total wings 120 so that the wings 120 define a substantially continuous outer perimeter for contacting the inner surface 44 of the nut 25 without the inner surface 44 of the nut 25 contacting the outer face 116 of the continuity member 110. The wings 120 are spaced circumferentially apart from each other about the annular body 111.

The wings 120 are flat, planar projections projecting tangentially with respect to the outer surface 116 of the annular body 111. Each wing 120 is generally trapezoidal in shape. Each wing 120 has a wide fixed end 121 which is formed to the annular body 111. The fixed end 121 is aligned along the axis of the continuity member 110 and along the axis A when applied in the connector 20. The wing 120 projects from the fixed end 121 to a narrower free end 122. The wings 120 are grouped in sets or pairs in which the fixed ends 121 of two wings 120 are aligned and proximate to each other, spaced just slightly apart. The wings 120 in a set are parallel and coplanar, as can be seen easily in the top plan view of FIG. 4B.

The annular body 111, being formed of a material or combination of materials having good resiliency and shape memory characteristics, maintains its shape. The wings 120, being formed integrally and monolithically to the annular body 111, are constructed of the same material or combination of materials and also have good resiliency and shape memory characteristics. The wings 120 extend out beyond the outer face 116 of the continuity member 110 and resist inward compression. Therefore, the wings 120 exert a bias radially outward in opposition to the radial compression pre-loaded on the continuity member 110 during assembly into the toroidal volume 70 of the connector 20.

The continuity member 110 has a front end 123 and an opposed rear end 124. When assembled into the connector 20, the front end 123 of the continuity member 20 is directed forward toward the front end 40 of the coupling nut 25 and the rear end 124 is directed rearward toward the rear end 73 of the body 22. When disposed in the toroidal volume 70, the wings 120 are slightly compressed radially inwardly in this pre-loaded state. The wings 120 thus maintain contact and maintain the electrical continuity B with the inner surface 44 of the coupling nut 25. The smooth inner surface 115 of the continuity member 110 allows the continuity member 110 to rotate freely on the face 66*b* of the inner post 31 and maintain the electrical continuity B between the continuity member 110 and the inner post 31. In this manner, the electrical continuity B from the coupling nut 25 to the continuity member 35 to the inner post 31 is maintained, and is maintained in a radial direction only.

Figure 5C:
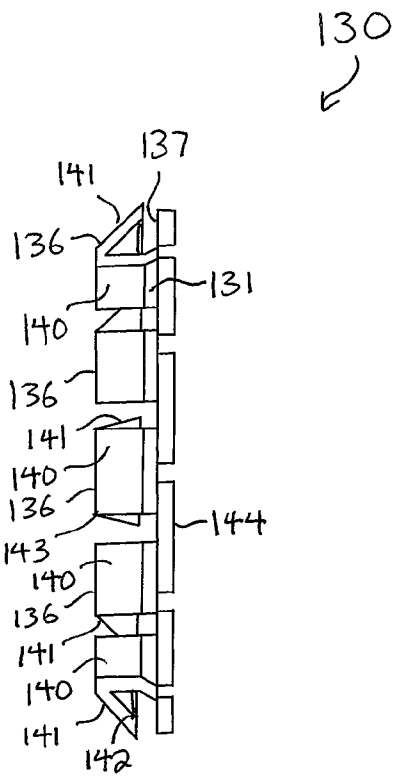
FIGS. 5A, 5B, 5C are perspective, top plan, and side elevation views, respectively, of yet another embodiment of the continuity member of FIG. 1A.
Figure 5B:
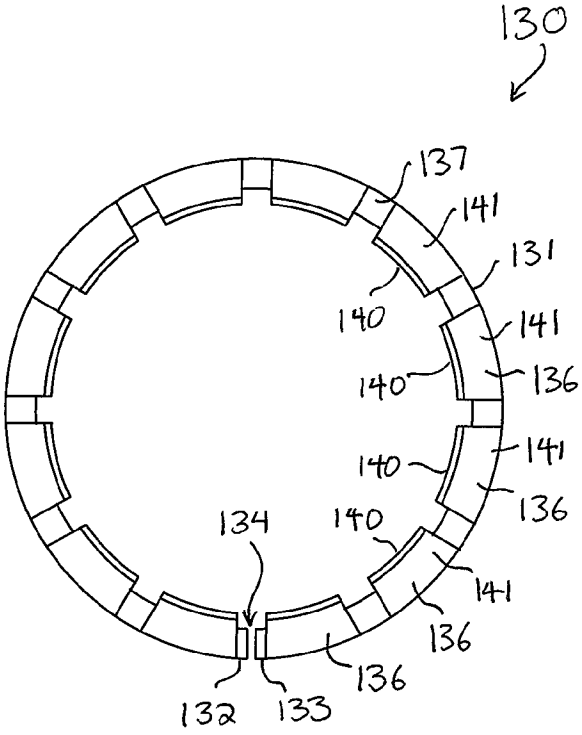
Figure 5A:
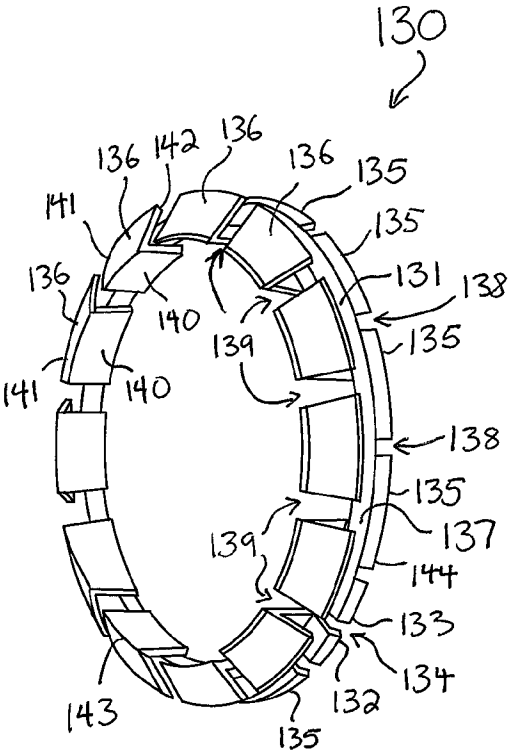

FIGS. 5A-5C show several views of another alternate embodiment of a continuity member 130. The continuity member 130 is easily substituted into the connector 20 in place of the continuity member 35 shown in FIGS. 1A-3C. The continuity member 130 is formed from a single piece of sheet metal having the material properties of good electrical conductivity and good resiliency and shape memory. The continuity member 130 includes a body 131 rolled or bent into an annular shape so as to generally define an annular body 131. The annular body 131 has opposed ends 132 and 133, which in the embodiment shown in FIGS. 5A and 5B are blunt and squared-off, and has a length which is bent into a circumference. The ends 132 and 133 are spaced apart when the annular body 131 is bent into an annulus, thereby defining a thin gap 134 so that the continuity member 130 is a severed ring. The annulus of the annular body 131 defines a base ring 137 with fingers depending both forwardly and rearwardly from the base ring 137. The base ring 137 is circular, flat, and aligned with a plane containing radii extending from a center of the continuity member 130. The rear side of the base ring 137 is substantially smooth.

A plurality of fingers 135 extends from the base ring 137 normal to the base ring 137. Each of the fingers 135 is short and wide; notches 138 extending up to the base ring 137 space the fingers 135 apart from each other. Another set of fingers 136, disposed oppositely from the fingers 135 on the base ring 137, extend forwardly from the base ring 137 and are separated by notches 139. Each of the fingers 136 includes a base portion 140 and a free portion 141. The base portion 140 is axially-aligned and extends from the base ring 137 normal to the base ring 137. The free portion 141 is formed integrally to the base portion 140 and is bent outwardly and rearwardly, and terminates with a very slightly inwardly-turned lip 142. The base ring 137, the base portion 140, and the free portion 141 cooperate to define, in cross-section, a generally triangular shape.

Each of the fingers 135 and 136 is punched and bent from the annular body 131 itself. The fingers 135 and 136 are formed integrally and monolithically with the annular body 131. In this way, a single piece of material is cut, then punched and bent to form the fingers 135 and 136, then bent into the annulus shape of the continuity member 130, providing an effective and efficient way to form the continuity member 130. In the embodiment shown in FIGS. 5A-5C, there are twelve fingers 135 and twelve fingers 136; in other embodiments, there may be a greater or fewer number of fingers 135 and 136, however, there preferably are at least three fingers 135 and 136 so that the fingers 135 and 136 define an outer perimeter for contacting the inner surface 44 of the coupling nut 25 without the inner surface 44 of the coupling nut 25 contacting the outer face 136 of the continuity member 130. The fingers 135 are spaced circumferentially apart from each other about the annular body 131. Likewise, the fingers 136 are spaced circumferentially apart from each other about the annular body 131.

The annular body 131, being formed of a material or combination of materials having good resiliency and shape memory characteristics, maintains its shape. The fingers 135 and 136, being formed integrally and monolithically to the annular body 131, are constructed of the same material or combination of materials and also have good resiliency and shape memory characteristics. The fingers 136 extend out beyond the base ring 137 of the continuity member 130 and resist inward compression. Therefore, the fingers 136 exert a bias radially outward in opposition to the pre-loaded radial compression imparted during assembly of the connector 20 and application of the coupling nut 25 over the continuity member 130.

The continuity member 130 has a front end 143 and an opposed rear end 144. When assembled into the connector 20, the front end 143 of the continuity member 20 is directed forward toward the front end 40 of the coupling nut 25 and the rear end 144 is directed rearward toward the rear end 73 of the body 22. When so disposed, the fingers 136 extends forward and obliquely in a partially-rearward, partially-outward direction. The fingers 136 are slightly compressed radially inwardly in this pre-loaded state. The free portions 141 of the fingers 136 are directed radially outward for sliding contact against the inner surface 44 of the coupling nut 25, thereby maintaining electrical continuity B between the coupling nut 25 and the continuity member 130. The base portions 140 of the fingers 136 are directed radially inward, however, and are maintained in sliding contact with the face 66*b*, thereby maintaining electrical continuity B between the continuity member 130 and the inner post 31. The smooth inner faces of the base portions 140 allow the continuity member 130 to rotate freely on the face 66*b* of the inner post 31 and maintain the electrical continuity B between the coupling nut 25 and the inner post 31, and to maintain that electrical continuity B in a radial direction only.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A coaxial cable connector for coupling a coaxial cable to a mating port of an electronic component, the coaxial cable connector comprising:

a body, a post in the body, and a coupling nut mounted for movement on the post;

a continuity member disposed radially between the post and the coupling nut; and an electrical continuity established and maintained among the coupling nut, the continuity member, and the post, wherein the electrical continuity is maintained regardless of an application of the coupling nut to the mating port wherein the continuity member comprises an annular body having opposed front and rear ends and a finger projecting from the annular body, the finger comprising a fixed end formed to the annular body, a free end opposite the fixed end, and an outwardly convex profile between the fixed and free ends of the finger and between the front and rear ends of the annular body.

2. The coaxial cable connector of claim 1 wherein the electrical continuity is maintained regardless of an axial force on the continuity member.

3. The coaxial cable connector of claim 1, wherein the electrical continuity is maintained regardless of a compressive force on the continuity member.

4. The coaxial cable connector of claim 1, wherein the electrical continuity extends from the coupling nut to the continuity member to the post in a radial direction only.

5. A coaxial cable connector for coupling a coaxial cable to a mating port of an electronic component, the coaxial cable connector comprising:

a body, a post in the body, and a coupling nut mounted for movement on the post;

a continuity member disposed radially between the post and the coupling nut, the continuity member maintaining an electrical continuity with the post and the coupling nut; and the continuity member comprises an annular body having opposed front and rear ends and a finger projecting from the annular body with a force, the force oriented in a radial direction only;

wherein the finger comprises a fixed end formed to the annular body, a free end opposite the fixed end, and an outwardly convex profile between the fixed and free ends of the finger and between the front and rear ends of the annular body.

6. The coaxial cable connector of claim 5, wherein the electrical continuity is oriented in the radial direction only between the coupling nut and the continuity member, and is oriented in the radial direction only between the continuity member and the post.

7. The coaxial cable connector of claim 5, wherein the finger is configured for displacement only in the radial direction.

8. The coaxial cable connector of claim 5, wherein the electrical continuity is maintained regardless of an axial force on the continuity member.

9. The coaxial cable connector of claim 5, wherein the electrical continuity is maintained regardless of a compressive force on the continuity member.

10. The coaxial cable connector of claim 5, wherein the continuity member is configured to maintain the electrical continuity when the coupling nut is free of the mating port of the electronic component and when the coupling nut is applied to the mating port of the electronic component.

11. A coaxial cable connector for coupling a coaxial cable to a mating port of an electronic component, the coaxial cable connector comprising:

a body, a post in the body, and a coupling nut mounted for movement on the post;

a continuity member carried between the post and the coupling nut;

an electrical continuity among the coupling nut, the continuity member, and the post; and the continuity member comprises an annular body having opposed front and rear ends and a finger projecting from the annular body and is configured to maintain the electrical continuity when the connector is free of the mating port of the electronic component and when the connector is applied to the mating port of the electronic component;

wherein the finger comprises a fixed end formed to the annular body, a free end opposite the fixed end, and an outwardly convex profile between the fixed and free ends and between the front and rear ends of the annular body.

12. The coaxial cable connector of claim 11, wherein the electrical continuity is maintained regardless of an axial force on the continuity member.

13. The coaxial cable connector of claim 11, wherein the electrical continuity is maintained regardless of a compressive force on the continuity member.

14. The coaxial cable connector of claim 11, wherein the electrical continuity extends from the coupling nut to the continuity member to the post in a radial direction only.

15. The coaxial cable connector of claim 11, wherein the finger is configured for displacement in a radial direction only.

16. A coaxial cable connector for coupling a coaxial cable to a mating port of an electronic component, the coaxial cable connector comprising:

a body, a post in the body, and a coupling nut mounted for movement on the post;

a continuity member carried between the post and the coupling nut, the continuity member including an annular body with opposed front and rear ends and a finger having a fixed end formed to the annular body, a free end opposite the fixed end, and an outwardly convex profile extending between the fixed and free ends of the finger and between the front and rear ends of the annular body;

a first state of the coupling nut characterized by the coupling nut free of the mating port of the electronic component, and a second state of the coupling nut characterized by the coupling nut applied to the mating port of the electronic component; and the continuity member maintains an electrical continuity between the coupling nut and the post when the coupling nut is in the first state and when the coupling nut is in the second state, and also during movement of the coupling nut between the first and second states.

17. The coaxial cable connector of claim 16, wherein movement of the coupling nut from the first state to the second state exerts no compressive change on the continuity member.

18. The coaxial cable connector of claim 16, wherein the coupling nut exerts no change in a compressive force on the post when the coupling nut is in the second state compared to the first state.

19. The coaxial cable connector of claim 16, wherein the electrical continuity is maintained regardless of an axial force on the continuity member.

20. The coaxial cable connector of claim 16, wherein the electrical continuity extends from the coupling nut to the continuity member to the post in a radial direction only.

21. The coaxial cable connector of claim 16, wherein:

in the first and second states of the coupling nut, the finger has first and second displacements, respectively, from the annular body; and the first and second radial displacements are equal.

22. The coaxial cable connector of claim 21, wherein the first and second displacements are in a radial direction only.

* * * * *